US008662918B2

(12) United States Patent
Tsai et al.

(10) Patent No.: US 8,662,918 B2
(45) Date of Patent: Mar. 4, 2014

(54) ELECTRICAL CONNECTOR

(75) Inventors: Shang Ju Tsai, Keelung (TW); Yan Xian Yuan, Guangzhou (CN); Yao Li, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 9 days.

(21) Appl. No.: 13/570,506

(22) Filed: Aug. 9, 2012

(65) Prior Publication Data

US 2013/0323976 A1 Dec. 5, 2013

(30) Foreign Application Priority Data

Jun. 5, 2012 (CN) ..... 2012 2 0261254 U

(51) Int. Cl.
*H01R 27/00* (2006.01)

(52) U.S. Cl.
USPC ..... 439/516

(58) Field of Classification Search
USPC ..... 439/885, 516
See application file for complete search history.

(56) References Cited

U.S. PATENT DOCUMENTS 3,621,116 A * 11/1971 Adams ..... 174/254
4,089,041 A * 5/1978 Lockard ..... 361/767
4,471,158 A * 9/1984 Roberts ..... 174/541
5,060,372 A * 10/1991 Capp et al. ..... 29/883
5,975,959 A * 11/1999 Joly ..... 439/630
6,086,413 A * 7/2000 Karasik et al. ..... 439/516
6,764,336 B2 * 7/2004 Ma et al. ..... 439/604
6,796,852 B2 * 9/2004 Okamoto ..... 439/736
7,144,259 B2 * 12/2006 Ice et al. ..... 439/79
7,503,112 B2 * 3/2009 Ice et al. ..... 29/883
7,540,782 B2 * 6/2009 Takahashi et al. ..... 439/630
7,824,225 B1 * 11/2010 Wang ..... 439/630
7,871,298 B2 * 1/2011 Guo et al. ..... 439/630
7,959,478 B2 * 6/2011 Chiu et al. ..... 439/885
7,980,895 B2 * 7/2011 Berens et al. ..... 439/607.05
8,021,175 B2 * 9/2011 Kim ..... 439/159
8,435,050 B2 * 5/2013 Tziviskos et al. ..... 439/79
2002/0061686 A1 * 5/2002 Ma et al. ..... 439/736
2004/0242086 A1 * 12/2004 Takagi ..... 439/885
2005/0232641 A1 * 10/2005 Ice et al. ..... 398/162
2010/0112862 A1 * 5/2010 Chiu et al. ..... 439/607.23
2012/0214351 A1 * 8/2012 Shiratori et al. ..... 439/692
2013/0090022 A1 * 4/2013 Shiratori et al. ..... 439/692

* cited by examiner

*Primary Examiner* — Ross Gushi
(74) *Attorney, Agent, or Firm* — Morris Manning & Martin LLP; Tim Tingkang Xia, Esq.

(57) ABSTRACT

An electrical connector includes an insulating body and a plurality of first terminals, disposed side by side in the insulating body. The insulating body is formed with at least two bridging-portion removal holes. Bridging portions between the first terminals are capable of being removed through the bridging-portion removal holes. The at least two bridging-portion removal holes are respectively formed through plate surfaces of the insulating body, and the at least two bridging-portion removal holes are arranged in a staggered manner in a front-to-rear direction.

18 Claims, 8 Drawing Sheets

ELECTRICAL CONNECTOR

CROSS-REFERENCE TO RELATED APPLICATION

This non-provisional application claims priority under 35 U.S.C. §119(a) on Patent Application No. 201220261254.5 filed in P.R. China on Jun. 5, 2012, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector having a tongue that maintains strength.

BACKGROUND OF THE INVENTION

An electrical connector currently available on the market includes a body, a through hole and a plurality of terminals. The body extends forwards to form a tongue. The tongue is long and thin, and is formed with a plurality of receiving slots side by side. The through hole is located at a front portion of the tongue and formed through upper and lower surfaces of the tongue. The through hole is disposed transversely in the tongue, and in communication with all the receiving slots. The terminals are respectively disposed in the receiving slots.

During assembly of the electrical connector, first, a terminal group is provided. The terminal group includes the terminals and bridging portions each connecting neighboring two of the terminals. The bridging portions are arranged in a row on the terminal group. First, the terminals are disposed in the receiving slots, so that the bridging portions are exposed in the through hole. Since the bridging portions are arranged in a row and exposed in the through hole, a jig may be used to break the bridging portions through the through hole, so as to separate the terminals respectively.

Since the through hole is formed through the tongue, the through hole is in transverse communication with all the receiving slots, and the number of the through hole is one, the strength of the tongue cannot be maintained easily. Especially when the tongue is mated to a socket, the tongue needs to be inserted into a mating cavity of the socket. At this time, a force is applied to the tongue unevenly, and since the tongue is long and thin, the tongue may be broken from two sides of the through hole.

Moreover, during assembly of the electrical connector, that is, in the process of installing the terminal group into the receiving slots, since the bridging portions are arranged in a row on the terminal group, the distance between other portions of the terminals, that is, between portions without the bridging portions, cannot be maintained easily, resulting in a deviation in the distance between the terminals.

Therefore, a heretofore unaddressed need exists in the art to address the aforementioned deficiencies and inadequacies.

SUMMARY OF THE INVENTION

In one aspect, the present invention is directed to an electrical connector having a tongue with good strength.

In one embodiment, the electrical connector according to the present invention includes an insulating body and a plurality of first terminals, disposed side by side in the insulating body. The insulating body is formed with at least two bridging-portion removal holes. Bridging portions between the first terminals are capable of being removed through the bridging-portion removal holes. The at least two bridging-portion removal holes are respectively formed through plate surfaces of the insulating body, and the at least two bridging-portion removal holes are arranged in a staggered manner in a front-to-rear direction. In the embodiments of the present invention, through the staggered arrangement of the bridging-portion removal holes in the front-to-rear direction, each of the bridging-portion removal holes is only in communication with several neighboring first receiving slots. Compared with the related art where a through hole is arranged in one row and is in communication with all the receiving slots, the strength of the tongue of the insulating body according to embodiments of the present invention is greatly enhanced, which can effectively prevent a long and thin tongue from being broken due to an excessive force.

Further, a material breaking portion is formed after the bridging portion corresponding to each of the first terminals is removed, and the material breaking portion is located in the bridging-portion removal hole. The material breaking portions of at least neighboring two of the first terminals are staggered in a front-rear manner. The insulating body has a tongue. The plurality of the first terminals are disposed side by side in a plurality of first receiving slots formed in a bottom surface of the tongue. A plurality of second terminals are disposed side by side in a plurality of second receiving slots formed in a top surface of the tongue. The first terminal is installed into the first receiving slot from bottom to top. A side edge of the second terminal is formed with at least one breaking portion, and the breaking portions of the second terminals are disposed behind the tongue and located in the same row. The bridging-portion removal holes are arranged in three rows in the front-to-rear direction on the insulating body, and projections in the front-to-rear direction of the neighboring bridging-portion removal holes staggered in the front-to-rear direction partially overlap. Alternatively, the bridging-portion removal holes are arranged in two rows in the front-to-rear direction on the insulating body, and at least one of the rows includes the bridging-portion removal holes disposed at an interval. Projections in the front-to-rear direction of at least two of the bridging-portion removal holes staggered in the front-to-rear direction partially overlap. Projections of neighboring two of the bridging-portion removal holes in the front-to-rear direction partially overlap. The insulating body has a tongue, and the first terminals are disposed side by side in the tongue.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
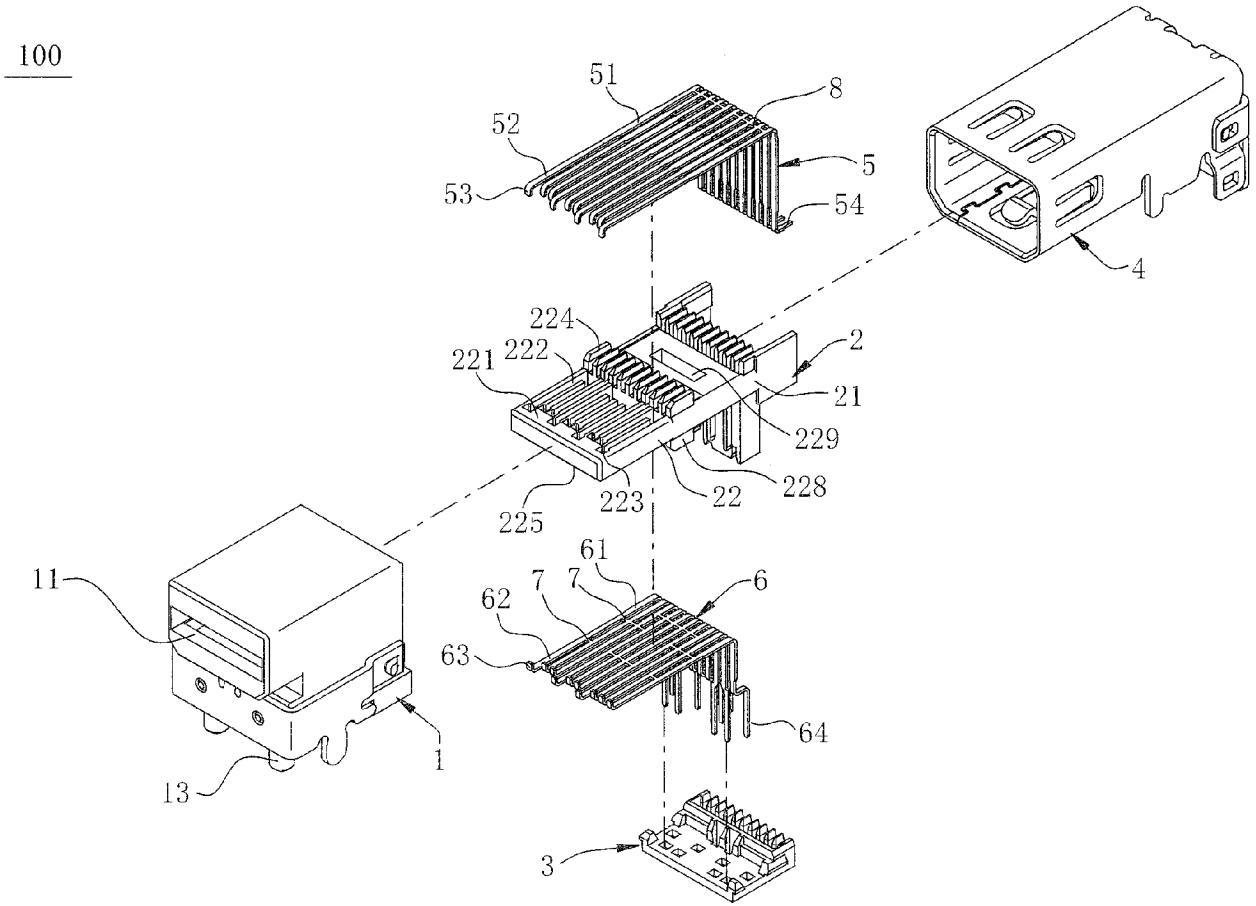
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 2:
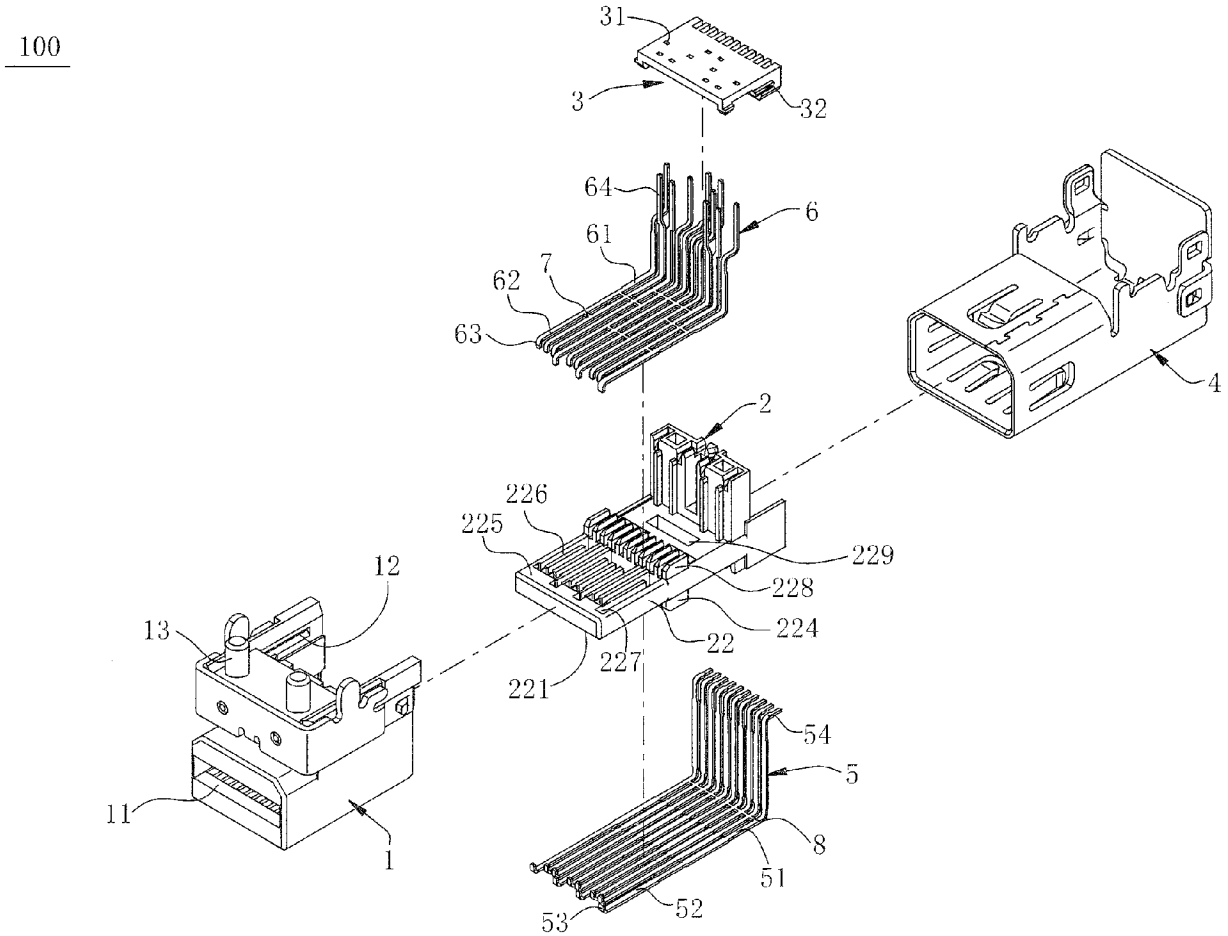
FIG. 2 is a schematic three-dimensional exploded view of the electrical connector according to one embodiment of the present invention from another angle of view.

Referring to FIGS. 1 and 2, in one embodiment according to the present invention an electrical connector 100 includes a frame 1, an insulating body 2, a fixing spacer 3, a shell 4, a plurality of first terminals 6, a plurality of second terminals 5, a plurality of bridging portions 7, and a plurality of connecting portions 8.

Referring to FIGS. 1 and 2, the frame 1 has a receiving cavity 11. The receiving cavity 11 is formed through the frame 1 backwards from a front end surface of the frame 1. An engaging slot 12 is recessed in each of inner walls of two opposite side surfaces of the frame 1. Two positioning posts 13 protrude downwards from a bottom surface of the frame 1, and are used to fix the electrical connector 100 to a circuit board (not shown).

Figure 6:
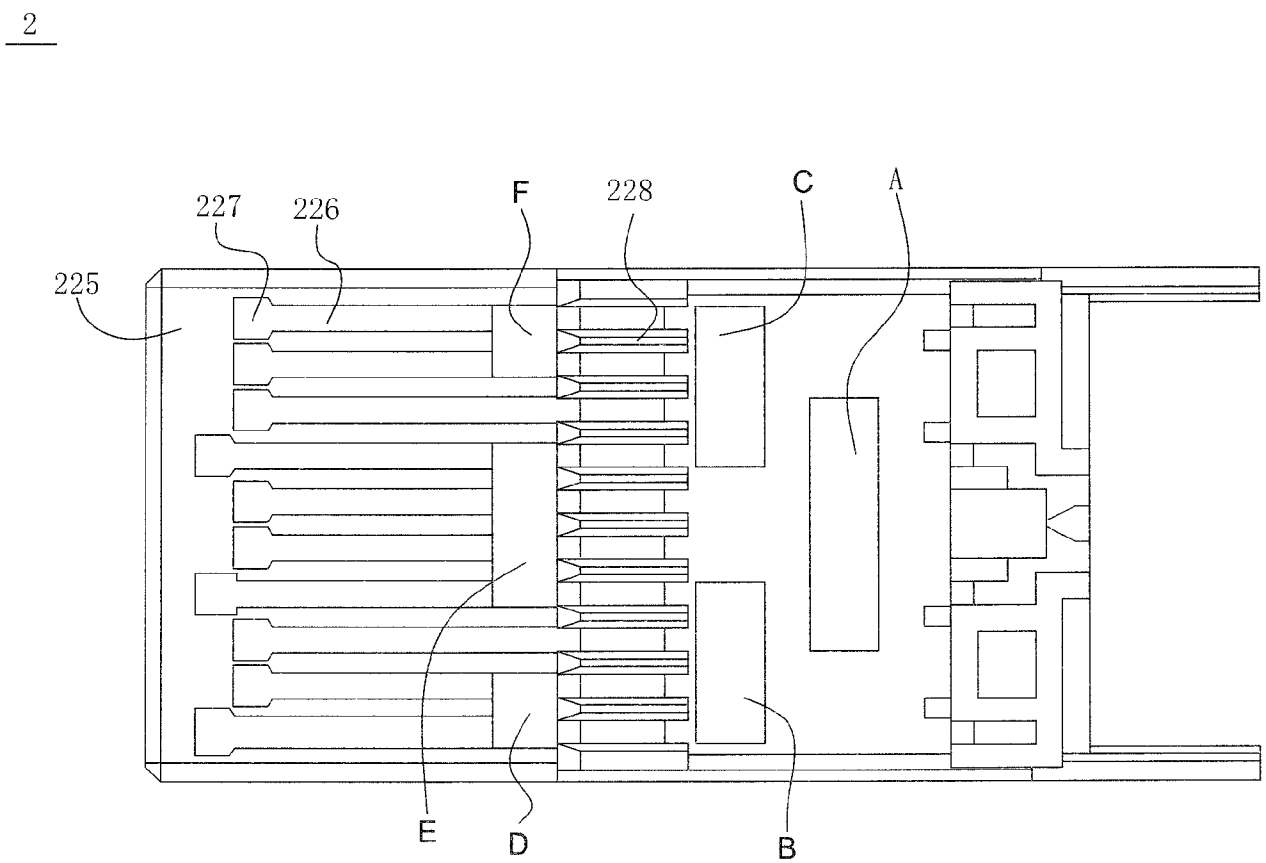
FIG. 6 is a top view of the tongue in the electrical connector according to one embodiment of the present invention.

Referring to FIGS. 1, 2 and 6, the insulating body 2 has a main body 21. The main body 21 extends forwards to form a tongue 22. The tongue 22 is in the shape of a flat plate, which has a large length, protrudes far from the front end surface of the frame 1, and has a small thickness. The tongue 22 has an upper surface 221 and a lower surface 225 disposed opposite to the upper surface 221. The tongue 22 is further formed with a plurality of bridging-portion removal holes 229, and each of the bridging-portion removal holes 229 is formed through the upper surface 221 and the lower surface 225. As shown in the top view of FIG. 6, the bridging-portion removal holes 229 are arranged in three rows, which are a first row, a second row, and a third row in sequence from back to front. For the convenience of illustration, the bridging-portion removal holes 229 are marked as follows: the first row includes one bridging-portion removal hole 229, which is marked with "A"; the second row includes two bridging-portion removal holes 229, which are disposed at an interval, and are marked with "B" and "C" respectively; the third row includes three bridging-portion removal holes 229, which are disposed at an interval, and are marked with "D", "E" and "F" respectively. Projections of "A" and "B" along an extending direction of the tongue partially overlap, projections of "A" and "C" along the extending direction of the tongue partially overlap, projections of "B" and "D" along the extending direction of the tongue partially overlap, projections of "C" and "F" along the extending direction of the tongue partially overlap, projections of "B" and "E" along the extending direction of the tongue partially overlap, projections of "C" and "E" along the extending direction of the tongue partially overlap, and projections of "A" and "E" along the extending direction of the tongue partially overlap.

Referring to FIGS. 1, 2 and 6, the upper surface 221 is formed with a plurality of second receiving slots 222. The second receiving slots 222 are disposed side by side and extend forwards along the extending direction of the tongue 22. Any two of the second receiving slots 222 are disposed in parallel, and any neighboring two of the second receiving slots 222 are spaced by the same distance. Each of the second receiving slots 222 is formed at a front portion thereof with a second retaining slot 223. The second retaining slot 223 is recessed in the upper surface 221. The second retaining slot 223 is in communication with the second receiving slot 222 and adjacent to a front portion of the tongue 22. Two second positioning portions 224 respectively protrude upwards from two opposite side walls of each of the second receiving slots 222. The second positioning portions 224 are distributed in a row on the upper surface 221.

Referring to FIGS. 1, 2 and 6, the lower surface 225 is formed with a plurality of first receiving slots 226. Each of the first receiving slots 226 is independent of each of the second receiving slots 222, that is, each of the first receiving slots 226 is separated from each of the second receiving slots 222 by an insulating material. The first receiving slots 226 are disposed side by side and extend forwards along the extending direction of the tongue 22. Any two of the first receiving slots 226 are disposed in parallel, and any neighboring two of the first receiving slots 226 are spaced by the same distance. Each of the first receiving slots 226 is formed at a front portion thereof with a first retaining slot 227. The first retaining slot 227 is recessed upwards from the lower surface 225. The first retaining slot 227 is in communication with the first receiving slot 226 and adjacent to the front portion of the tongue 22. Two first positioning portions 228 respectively protrude downwards from two opposite side walls of each of the first receiving slots 226. The first positioning portions 228 are distributed in a row on the lower surface 225.

Referring to FIGS. 1 and 2, the fixing spacer 3 is located below the tongue 22. The fixing spacer 3 is formed with a plurality of fastening slots 31. The fastening slots 31 are formed through upper and lower surfaces of the fixing spacer 3. Each of two sides of the fixing spacer 3 is provided with a protruding block 32.

Referring to FIGS. 1 and 2, the shell 4 wraps the frame 1 and the insulating body 2, and the shell 4 is made of a metal material to shield interference with external signals.

Figure 3:
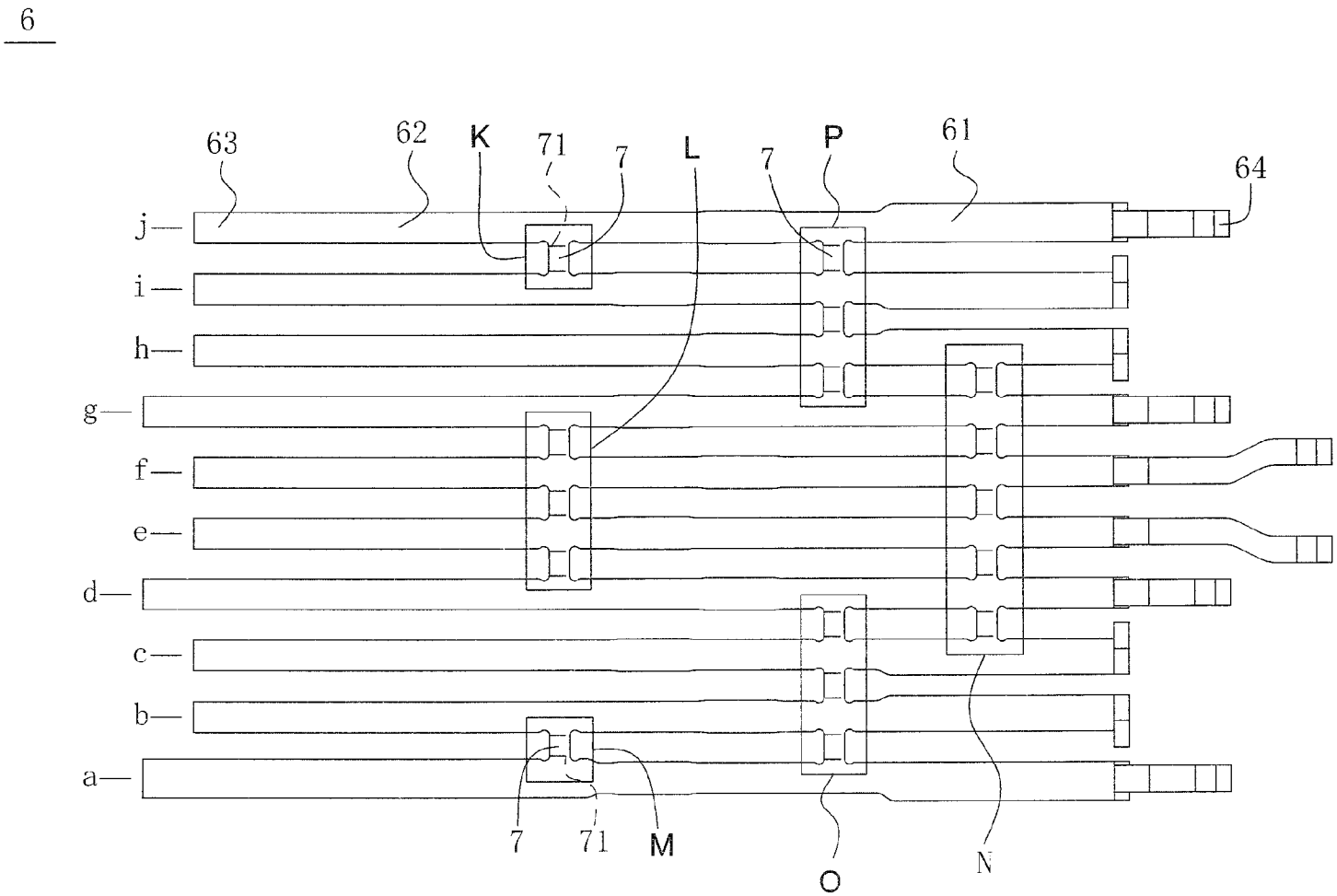
FIG. 3 is a schematic assembled view of first terminals and bridging portions in the electrical connector according to one embodiment of the present invention.

Referring to FIGS. 1, 2 and 3, the first terminals 6 are disposed side by side and extend forwards along the extending direction of the tongue 22. The first terminals 6 are arranged in a row. As shown in the top view, any neighboring two of the first terminals 6 are spaced by the same distance, and any two of the first terminals 6 are disposed in parallel. Each of the first terminals 6 has a first body portion 61 and a first mating portion 62 extending forwards from the first body portion 61. The first mating portion 62 is disposed horizontally and extends by a distance slightly smaller than the length of the tongue 22. Further, each of the first mating portions 62 has a small width. One end of the first mating portion 62 is bent upwards and extends to form a first fastening portion 63, and the first body portion 61 is bent downwards and extends to form a first soldering portion 64 for being soldered to the circuit board (not shown).

Figure 4:
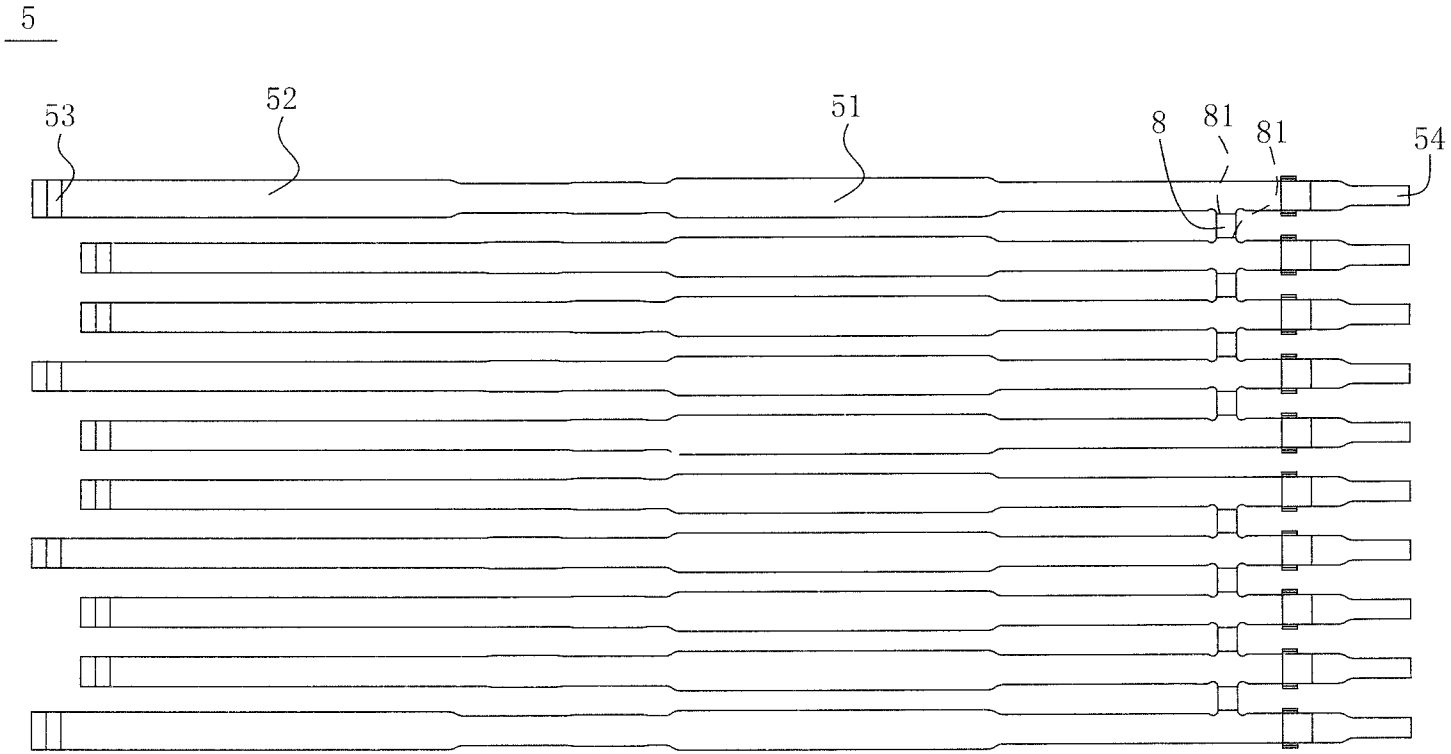
FIG. 4 is a schematic assembled view of second terminals and connecting portions in the electrical connector according to one embodiment of the present invention.

Referring to FIGS. 1, 2 and 4, the second terminals 5 are disposed side by side and extend forwards along the extending direction of the tongue 22. The second terminals 5 are arranged in a row. As shown in the top view, any neighboring two of the second terminals 5 are spaced by the same distance, and any two of the second terminals 5 are disposed in parallel. Each of the second terminals 5 has a second body portion 51 and a second mating portion 52 extending forwards from the second body portion 51. The second mating portion 52 is disposed horizontally and extends by a distance slightly smaller than the length of the tongue 22. One end of the second mating portion 52 is bent downwards and extends to form a second fastening portion 53, and the second body portion 51 is bent downwards and extends backwards to form a second soldering portion 54 for being soldered to the circuit board (not shown).

Referring to FIGS. 1, 2 and 3, each of the bridging portions 7 connects neighboring two of the first terminals 6. Two material breaking portions 71 are respectively provided between two ends of each of the bridging portions 7 and the neighboring two first terminals 6, and the material breaking portions 71 of at least neighboring two of the first terminals 6 are staggered. For the convenience of illustration, the first terminals 6 are marked further with "a", "b", "c", "d", "e", "f", "g", "h", "i", and "j" in sequence from bottom to top. A description of how these terminals marked such may be utilized is given briefly below. For example, the bottommost first terminal 6 is referred to as terminal "a" or just "a", next to which a first terminal 6 is referred to as terminal "b" or just "b". Here, "a" and "b" are connected through the bridging portion 7, "b" and "c" are connected through the bridging portion 7, "c" and "d" are connected through the bridging portion 7, and the three bridging portions 7 are located in the same line and form a group O. "c" and "d", "d" and "e", "e" and "f", "f" and "g", and "g" and "h" are also connected through the bridging portions 7 respectively, the five bridging portions 7 are also located in the same line and form a group N, and the group N is located behind the group O. "g" and "h", "h" and "i", and "i" and "j" are also connected through the bridging portions 7 respectively, the three bridging portions 7 form a group P, and the group P is located before the group N. As shown in the top view, the group O and the group N are staggered in a front-rear manner, and the group N and the group P are staggered in a front-rear manner. In this embodiment, the group O and the group P are located in the same line. Alternatively, in other embodiments, the group O and the group P may not be disposed in the same line, that is, the group O, the group N, and the group P are staggered in pairs. To enhance the control over the distance between neighboring terminals, bridging portions 7 are also disposed between mating portions of the first terminals 6. The first mating portions 62 of "a" and "b" are connected through another one of the bridging portions 7, which is marked with M. The first mating portions 62 of "d" and "e", "e" and "f", and "f" and "g" are also connected through another one of the bridging portions 7, and the three bridging portions form a bridging portion group L. The first mating portions 62 of "i" and "j" are also connected through another one of the bridging portions 7, which is marked with K.

Referring to FIGS. 1, 2 and 4, a connecting portion 8 is disposed between neighboring two of the second terminals 5, and the connecting portion 8 connects the neighboring two second terminals 5. The connecting portions 8 are arranged in a row between the second terminals 5, and are located behind the main body 21. Two breaking portions 81 are provided between each of the connecting portions 8 and the neighboring two second terminals 5, and are used to separate the connecting portion 8 from the second terminals 5.

Figure 5:
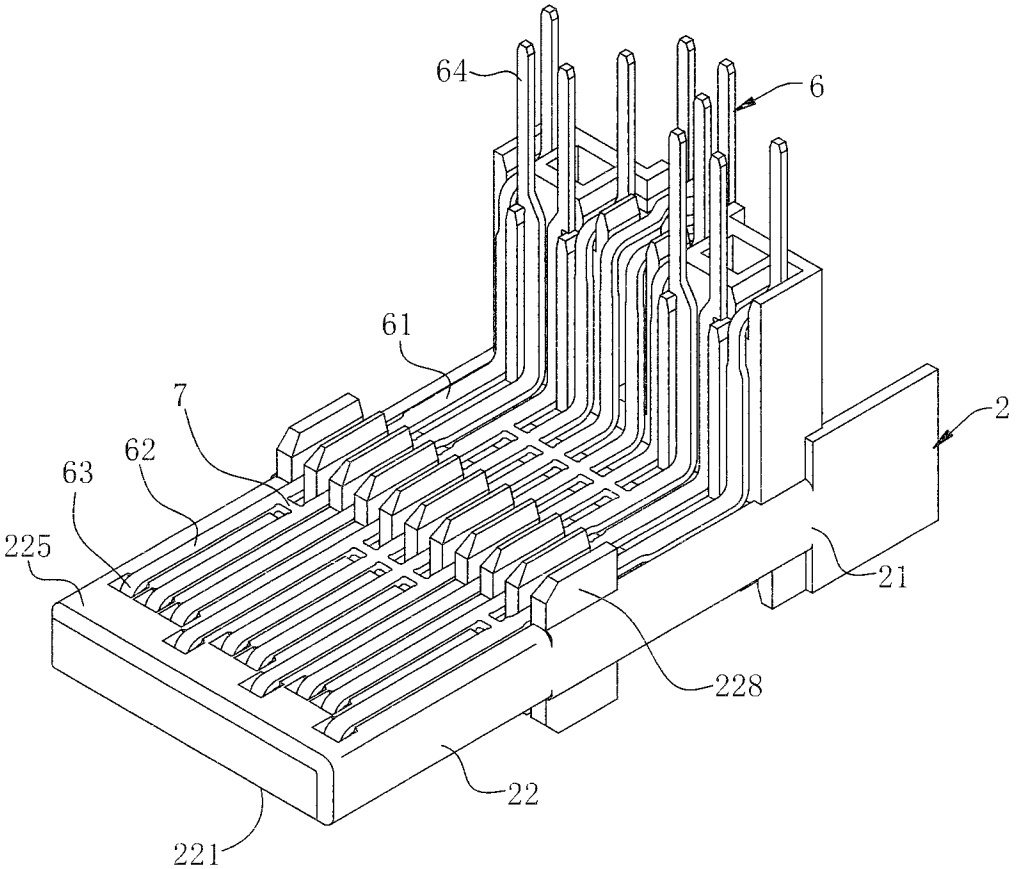
FIG. 5 is a schematic three-dimensional view of the electrical connector according to one embodiment of the present invention after the first terminals are assembled to a tongue together with the bridging portions.
Figure 7:
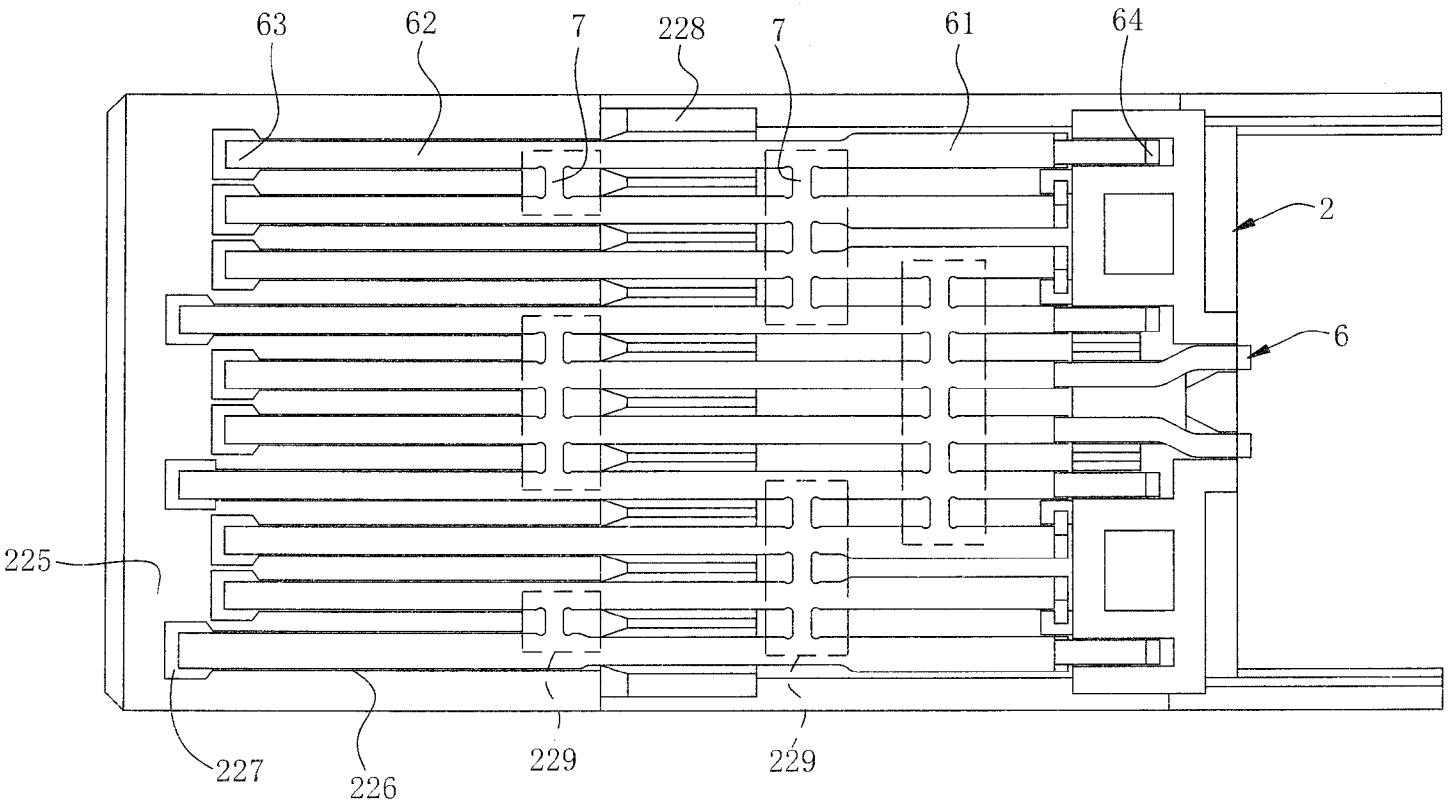
FIG. 7 is a top view of the electrical connector according to one embodiment of the present invention after the first terminals are assembled to the tongue together with the bridging portions.

During assembly, referring to FIGS. 3, 5 and 7, in a first step, the first terminals 6 disposed with the bridging portions 7 are installed into the first receiving slots 226 from bottom to top. The first body portions 61 and the first mating portions 62 respectively enter the first receiving slots 226 from the first positioning portions 228 of the lower surface 225, and the first fastening portions 63 are retained in the first retaining slots 227, so that the bridging portions 7 respectively correspond to the bridging-portion removal holes 229, which is specifically set as follows: M corresponds to D, L corresponds to E, K corresponds to F, O corresponds to B, P corresponds to C, and N corresponds to A.

Figure 8:
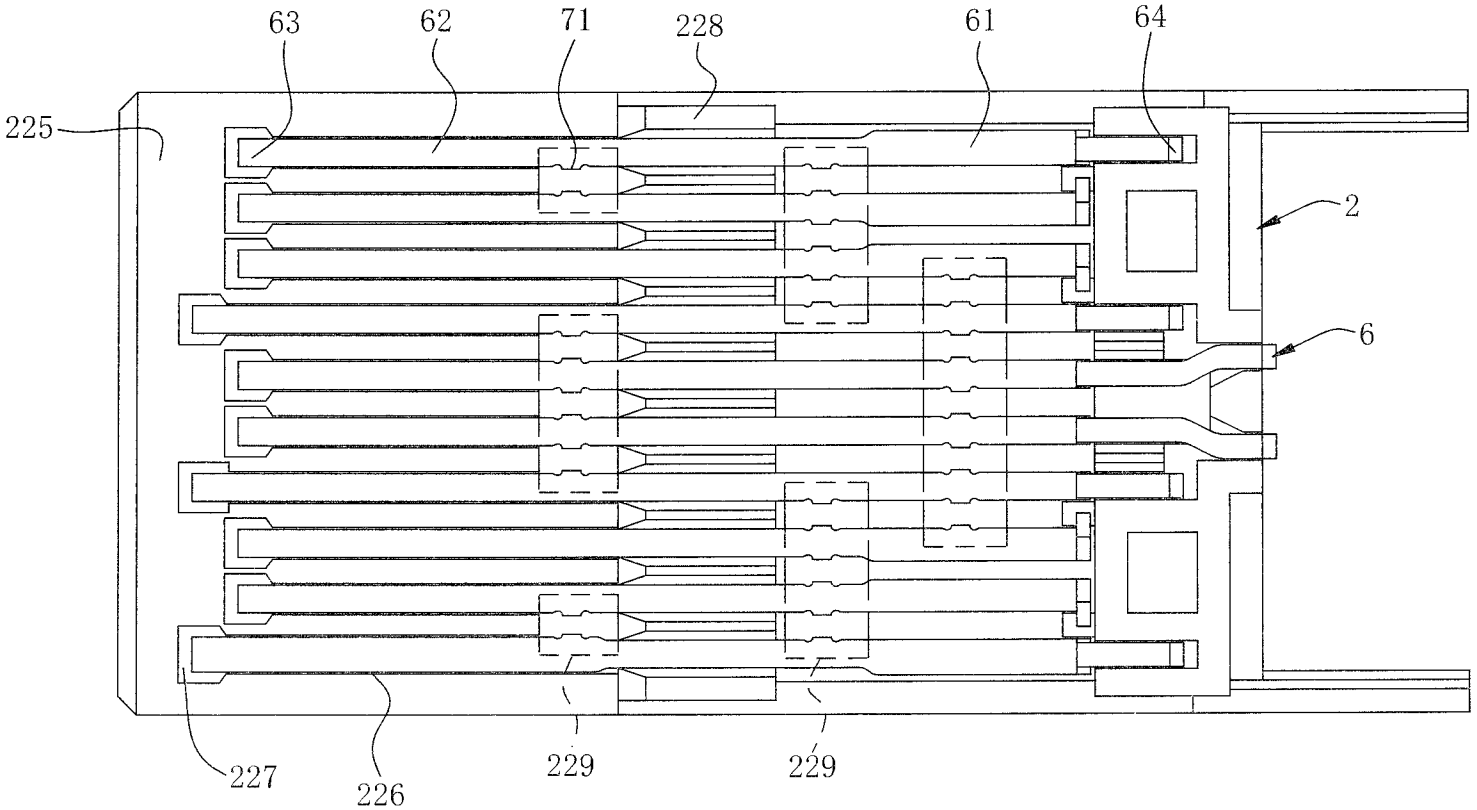
FIG. 8 is a schematic assembled view of the first terminals without the bridging portions and the tongue in the electrical connector according to one embodiment of the present invention.

Referring to FIGS. 5, 7 and 8, after the first terminals 6 are fixed, a jig (not shown) is used to break the bridging portions 7 connected between the first terminals 6 through the bridging-portion removal holes 229. Alternatively, the bridging portions 7 may be broken by other methods. The bridging portions 7 are separated from the first terminals 6 through the material breaking portions 71, so as to isolate each of the first terminals 6.

In a second step, referring to FIGS. 1, 2 and 4, the second terminals 5 disposed with the connecting portions 8 are installed into the second receiving slots 222 of the upper surface 221 from top to bottom. The second body portions 51 and the second mating portions 52 respectively enter the second receiving slots 222 from the second positioning portions 224 of the upper surface 221, so that the second fastening portions 53 are retained in the second retaining slots 223. As shown in the top view, the connecting portions 8 are located in the same row and behind the tongue 22. Likewise, the jig is used to break the connecting portions 8 between the second terminals 5. Alternatively, the connecting portions 8 may be broken by other methods. The connecting portions 8 are separated from the second terminals 5 through the breaking portions 81. Then, the first soldering portions 64 and the second soldering portions 54 are respectively inserted into the fastening slots 31 of the fixing spacer 3, so that the first soldering portions 64 and the second soldering portions 54 are fixed by the fastening slots 31, thereby tightly combining the insulating body 2 with the fixing spacer 3.

In a third step, referring to FIGS. 1, 2 and 8, the assembled insulating body 2 and fixing spacer 3 are then installed into the receiving cavity 11 of the frame 1 from back to front, so that the protruding blocks 32 at the two sides of the fixing spacer 3 enter the receiving cavity 11, and the tongue 22 protrudes from the front portion of the frame 1. After the protruding blocks 32 are engaged with and fixed in the engaging slots 12, the shell 4 is wrapped on the frame 1 and the insulating body 2. Thus, the assembly of the electrical connector 100 is completed.

Based on the above, among other things, the present invention has the following beneficial effects.

1. In the present invention, through the staggered arrangement of the bridging-portion removal holes 229 in the front-to-rear direction, each of the bridging-portion removal holes 229 is only in communication with several neighboring first receiving slots, so that compared with the related art where a through hole is arranged in a row and is in communication with the receiving slots, the strength of the tongue of the insulating body is greatly enhanced, which can effectively prevent a long and thin tongue from being broken due to an excessive force.

2. By disposing the staggered bridging portions 7 between the neighboring first terminals 6 in the front-to-rear direction, the long and thin first mating portions 62 are connected to each other through the bridging portions 7 staggered in a front-rear manner, so that a retaining force between the neighboring first mating portions 62 is increased, which can ensure that the same distance is maintained between the neighboring first terminals 6 after being installed into the first receiving slots 226, and avoid lateral deviations of the first terminals 6 due to a pressure applied by the side walls of the first receiving slots 226.

3. The material breaking portions 71 are disposed between the bridging portions 7 and the first terminals 6, and the material breaking portions 71 are used to separate the first terminals 6 from the bridging portions 7, thereby facilitating separation of the first terminals 6 from the bridging portions 7.

4. The first terminals 6 are installed into the tongue 22 from bottom to top, and the second terminals 5 are installed into the tongue 22 from top to bottom, so that compared with installing the first terminals 6 and the second terminals 5 into the tongue 22 from back to front in the related art, the friction of the first terminals 6 and the second terminals 5 with the side walls can be reduced, thereby preventing the first terminals 6 and the second terminals 5 from being bent or even deformed due to the friction with the side walls.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body; and a plurality of first terminals, disposed side by side in the insulating body, wherein the insulating body is formed with at least two bridging-portion removal holes, bridging portions between the first terminals are capable of being removed through the bridging-portion removal holes, the at least two bridging-portion removal holes are respectively formed through plate surfaces of the insulating body, and the at least two bridging-portion removal holes are arranged in a staggered manner in a front-to-rear direction, wherein the insulating body has a tongue, the first terminals are disposed side by side in a plurality of first receiving slots formed in a bottom surface of the tongue, and a plurality of second terminals are disposed side by side in a plurality of second receiving slots formed in a top surface of the tongue.

2. The electrical connector according to claim 1, wherein a material breaking portion is formed after the bridging portion corresponding to each of the first terminals is removed, and the material breaking portion is located in the bridging-portion removal hole.

3. The electrical connector according to claim 2, wherein the material breaking portions of at least neighboring two of the first terminals are staggered in a front-rear manner.

4. The electrical connector according to claim 1, wherein the first terminals are installed into the first receiving slots from bottom to top.

5. The electrical connector according to claim 1, wherein a side edge of each second terminal is formed with at least one breaking portion, and the breaking portions of the second terminals are disposed behind the tongue and located in the same row.

6. The electrical connector according to claim 1, wherein the bridging-portion removal holes are arranged in two rows in the front-to-rear direction on the insulating body, and at least one of the rows comprises the bridging-portion removal holes disposed at an interval.

7. The electrical connector according to claim 1, wherein projections of neighboring two of the bridging-portion removal holes in the front-to-rear direction partially overlap.

8. An electrical connector, comprising:

an insulating body; and a plurality of first terminals, disposed side by side in the insulating body, wherein the insulating body is formed with at least two bridging-portion removal holes, bridging portions between the first terminals are capable of being removed through the bridging-portion removal holes, the at least two bridging-portion removal holes are respectively formed through plate surfaces of the insulating body, and the at least two bridging-portion removal holes are arranged in a staggered manner in a front-to-rear direction, wherein the bridging-portion removal holes are arranged in three rows in the front-to-rear direction on the insulating body, and projections in the front-to-rear direction of the neighboring bridging-portion removal holes staggered in the front-to-rear direction partially overlap.

9. The electrical connector according to claim 8, wherein a material breaking portion is formed after the bridging portion corresponding to each of the first terminals is removed, and the material breaking portion is located in the bridging-portion removal hole.

10. The electrical connector according to claim 9, wherein the material breaking portions of at least neighboring two of the first terminals are staggered in a front-rear manner.

11. The electrical connector according to claim 8, wherein at least one of the rows comprises the bridging-portion removal holes disposed at an interval.

12. The electrical connector according to claim 8, wherein the insulating body has a tongue, and the first terminals are disposed side by side in the tongue.

13. An electrical connector, comprising:

an insulating body; and a plurality of first terminals, disposed side by side in the insulating body, wherein the insulating body is formed with at least two bridging-portion removal holes, bridging portions between the first terminals are capable of being removed through the bridging-portion removal holes, the at least two bridging-portion removal holes are respectively formed through plate surfaces of the insulating body, and the at least two bridging-portion removal holes are arranged in a staggered manner in a front-to-rear direction, wherein projections in the front-to-rear direction of at least two of the bridging-portion removal holes staggered in the front-to-rear direction partially overlap.

14. The electrical connector according to claim 13, wherein a material breaking portion is formed after the bridging portion corresponding to each of the first terminals is removed, and the material breaking portion is located in the bridging-portion removal hole.

15. The electrical connector according to claim 14, wherein the material breaking portions of at least neighboring two of the first terminals are staggered in a front-rear manner.

16. The electrical connector according to claim 13, wherein the bridging-portion removal holes are arranged in two rows in the front-to-rear direction on the insulating body, and at least one of the rows comprises the bridging-portion removal holes disposed at an interval.

17. The electrical connector according to claim 13, wherein projections of neighboring two of the bridging-portion removal holes in the front-to-rear direction partially overlap.

18. The electrical connector according to claim 13, wherein the insulating body has a tongue, and the first terminals are disposed side by side in the tongue.

* * * * *